US010378229B2

(12) United States Patent
Ben Dov et al.

(10) Patent No.: US 10,378,229 B2
(45) Date of Patent: Aug. 13, 2019

(54) POOL CLEANING ROBOT WITH BYPASS MECHANISM

(71) Applicant: MAYTRONICS LTD., Kibutz Yizrael (IL)

(72) Inventors: Boaz Ben Dov, Ram On (IL); Oded Golan, Kefar Tavor (IL)

(73) Assignee: .MAYTRONICS LTD, Kibbutz Yizrael (IL)

( * ) Notice: Subject to any disclaimer, the term of this patent is extended or adjusted under 35 U.S.C. 154(b) by 956 days.

(21) Appl. No.: 14/445,082

(22) Filed: Jul. 29, 2014

(65) Prior Publication Data

US 2015/0067974 A1 Mar. 12, 2015

Related U.S. Application Data

(60) Provisional application No. 61/875,066, filed on Sep. 8, 2013.

(51) Int. Cl.
*E04H 4/16* (2006.01)

(52) U.S. Cl.
CPC ..... *E04H 4/1654* (2013.01); *E04H 4/1663* (2013.01)

(58) Field of Classification Search
CPC ..... E04H 4/1654; E04H 4/1663
See application file for complete search history.

(56) References Cited

U.S. PATENT DOCUMENTS

| | | | | |
|---|---|---|---|---|
| 4,828,626 | A | 5/1989 | Meincke | |
| 6,112,354 | A * | 9/2000 | Stoltz | E04H 4/1663 15/1.7 |
| 6,314,983 | B1 | 11/2001 | Hatch | |
| 6,965,814 | B2 | 11/2005 | Hadari | |
| 9,127,472 | B2 | 9/2015 | Borg | |
| 2003/0201218 | A1 | 10/2003 | Henkin | |
| 2004/0040581 | A1 * | 3/2004 | Bruwer | E04H 4/1654 134/18 |
| 2011/0000035 | A1 | 1/2011 | Pichon | |

FOREIGN PATENT DOCUMENTS

| | | |
|---|---|---|
| CA | 1109209 | 9/1981 |
| CN | 201747089 | 2/2011 |
| CN | 202970016 U | 6/2013 |

* cited by examiner

*Primary Examiner* — Randall E Chin
(74) *Attorney, Agent, or Firm* — Reches Patents

(57) ABSTRACT

A cleaning robot may be provided and may include a housing comprising at least one inlet and an outlet; a filtering unit for filtering fluid; a bypass mechanism for bypassing the filtering unit; and a fluid suction unit that is arranged to direct towards the outlet fluid that (a) passes through the at least one inlet and (b) passes through at least one out of the filtering unit and the bypass mechanism.

42 Claims, 15 Drawing Sheets

10

POOL CLEANING ROBOT WITH BYPASS MECHANISM

RELATED APPLICATION

This application claims priority from U.S. provisional patent filing date Sep. 8, 2013 Ser. No. 61/875,066 which is incorporated herein by reference.

BACKGROUND

Cleaning robots contribute to the cleanliness of the fluid within a pool by moving within the pool and by filtering the fluid of the pool by means of a filter. The fluid of the pool enters the cleaning robot via one or more inlets, pass through the filter to be filtered and finally is outputted (after being filtered) as filtered fluid.

In some cleaning robots the effectiveness of the cleaning robot and even the mere movement of the cleaning robot require that the filtering unit to be clean. For example, some cleaning robots will stop moving if the filter is clogged. Yet other cleaning robots will not be able to climb the walls of the pool without a certain amount of fluid that is drawn-in by the cleaning robot and assist in attaching the cleaning robot to the walls of the pool.

There is a growing need to provide a cleaning robot that may be arranged to contribute to the cleanliness and sanitization of the pool surfaces and fluid even when its filters are partially or fully clogged.

SUMMARY

According to an embodiment of the invention there may be provided a cleaning robot with a bypass mechanism. The bypass mechanism can bypass one or more filters of a filtering unit.

According to an embodiment of the invention there may be provided a cleaning robot that may include a housing may include at least one inlet and an outlet; a filtering unit for filtering fluid; a bypass mechanism for bypassing the filtering unit; and a fluid suction unit that may be arranged to direct towards the outlet fluid that (a) passes through the at least one inlet and (b) passes through at least one out of the filtering unit or the bypass mechanism.

The bypass mechanism may be arranged to allow fluid to pass through the bypass mechanism when the cleaning robot may be tilted by at least a predefined tilt angle.

The degree of openness of the bypass mechanism may be responsive to a tilt angle of the cleaning robot.

The bypass mechanism may include a door. The door may movable between (a) a closed position in which the door prevents fluid to exit the bypass mechanism and flow towards the fluid suction unit, and (b) an open position in which the door allows fluid to exit from the bypass mechanism and flow towards the fluid suction unit. The position of the door may determine the openness level of the bypass mechanism.

The door may be pivotally coupled to a rotation axis and wherein the door rotates between the closed position and the open position.

The door may be coupled to a weight.

The weight may be connected to a door. For example—near a lower end of the door. The rotation axis may be located near an upper end of the door.

The door may be connected to a lever that may be pivotally coupled to a rotation axis.

The door may be connected to a hinge that may be pivotally coupled to a first rotation axis thereby allowing the door to pivot about the first rotation axis.

The door may be coupled to a lever that may be pivotally coupled to a second rotation axis; wherein the lever may be arranged to limit a pivoting of the door about the first rotation axis.

The lever may be connected to a weight.

The weight may be arranged to slide across the door when the door moves between the close position and the open position.

The bypass mechanism may be arranged to be opened in response to a suction level developed within an internal space formed in the housing.

The bypass mechanism may include a bypass mechanism inlet, a bypass mechanism outlet and a sealing element; wherein the sealing element may be arranged to be moved between (a) a closed position in which the sealing element prevents fluid to exit the bypass mechanism and flow towards the fluid suction unit, and (b) an open position in which the sealing element allows fluid to exit from the bypass mechanism and flow towards the fluid suction unit.

The bypass mechanism may include a spring that induces the sealing element to move towards the close position.

When the suction level developed within an internal space of the housing exceeds a suction threshold the sealing element may be moved towards the open position.

The bypass mechanism may be arranged to be opened in response to an intensity of flow of fluid at a point that may be upstream to the filtering unit.

The bypass mechanism may be arranged to be opened in response to an intensity of flow of fluid at a point that may be downstream to the filtering unit.

The bypass mechanism may be arranged to be opened in response to a rotational speed of a hydraulic movement mechanism of the cleaning robot.

The cleaning robot further may include a sensor. The sensor may be arranged to detect an occurrence of a bypass related event and the bypass mechanism may be arranged to respond to the occurrence of the bypass related event.

The bypass mechanism may include a motor that may be arranged to affect an openness level of the bypass mechanism in response to the occurrence of the bypass related event.

The sensor may be a robot tilt angle sensor.

The sensor may be a suction sensor.

The at least one inlet may include a bypass mechanism inlet and a filtering unit inlet.

The at least one inlet may include multiple bypass mechanism inlets and a filtering unit inlet.

The bypass mechanism may be closer to a sidewall of the housing than the filtering unit.

The bypass mechanism may be connected to a sidewall of the housing.

The bypass mechanism extends outside a sidewall of the housing.

The cleaning robot may include at least one additional bypass mechanism. The bypass mechanism and the at least one additional bypass mechanism form a plurality of bypass mechanisms.

At least two bypass mechanisms of the plurality of bypass mechanisms may differ from each other. For example—one bypass mechanism may be tilt angle triggered while another bypass mechanism may be pressure triggered.

At least two bypass mechanism of the plurality of bypass mechanisms may differ from each other by a triggering event that triggers an opening of the bypass mechanism.

At least two bypass mechanisms of the plurality of bypass mechanisms operate independently from each other.

A first bypass mechanism of the plurality of bypass mechanisms may be responsive to an openness level of another bypass mechanism of the plurality of bypass mechanisms. For example—when a pressure triggered bypass mechanism is opened it may ease the opening of a door of a tilt angle triggered bypass mechanism as the opening of the pressure triggered bypass mechanism may lower the suction within the housing and that reduction may ease an opening of a door of a tilt angle triggered bypass mechanism.

An opening of first bypass mechanism of the plurality of bypass mechanisms may ease an opening of another bypass mechanism of the plurality of bypass mechanisms.

An opening of first bypass mechanism of the plurality of bypass mechanisms may increase a difficulty of an opening of another bypass mechanism of the plurality of bypass mechanisms.

A first bypass mechanism of the plurality of bypass mechanisms may be arranged to be opened in response to a tilt level of the cleaning robot and a second bypass mechanism of the plurality of bypass mechanisms may be arranged to be opened in response to a clogging level of the filtering unit.

A first bypass mechanism of the plurality of bypass mechanisms may be arranged to be opened in response to a tilt level of the cleaning robot and a second bypass mechanism of the plurality of bypass mechanisms may be arranged to be opened in response to a suction level developed within an internal space formed in the housing.

A first bypass mechanism of the plurality of bypass mechanisms may have an opening located at a bottom of the housing and a second bypass mechanism of the plurality of bypass mechanisms may have an opening located at a sidewall of the housing.

A first bypass mechanism of the plurality of bypass mechanisms may include a sensor and a motor activated by the sensor and wherein a second bypass mechanism of the plurality of bypass mechanisms does not include a sensor or a motor activated by the sensor.

A degree of openness of the bypass mechanism may be responsive to (a) a tilt angle of the cleaning robot and to (b) a suction level developed within an internal space formed in the housing.

There may be provided a cleaning robot that includes any combination of any components illustrated in the summary section of the application or in the specification.

There may be provided a cleaning robot that includes any combination of any components illustrated in any claims of the application.

If, for example, a cleaning robot include more than a single bypass mechanism then any of the bypass mechanism may have any structure illustrated in the summary, the specification or the claims.

BRIEF DESCRIPTION OF THE DRAWINGS

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

Figure 1:
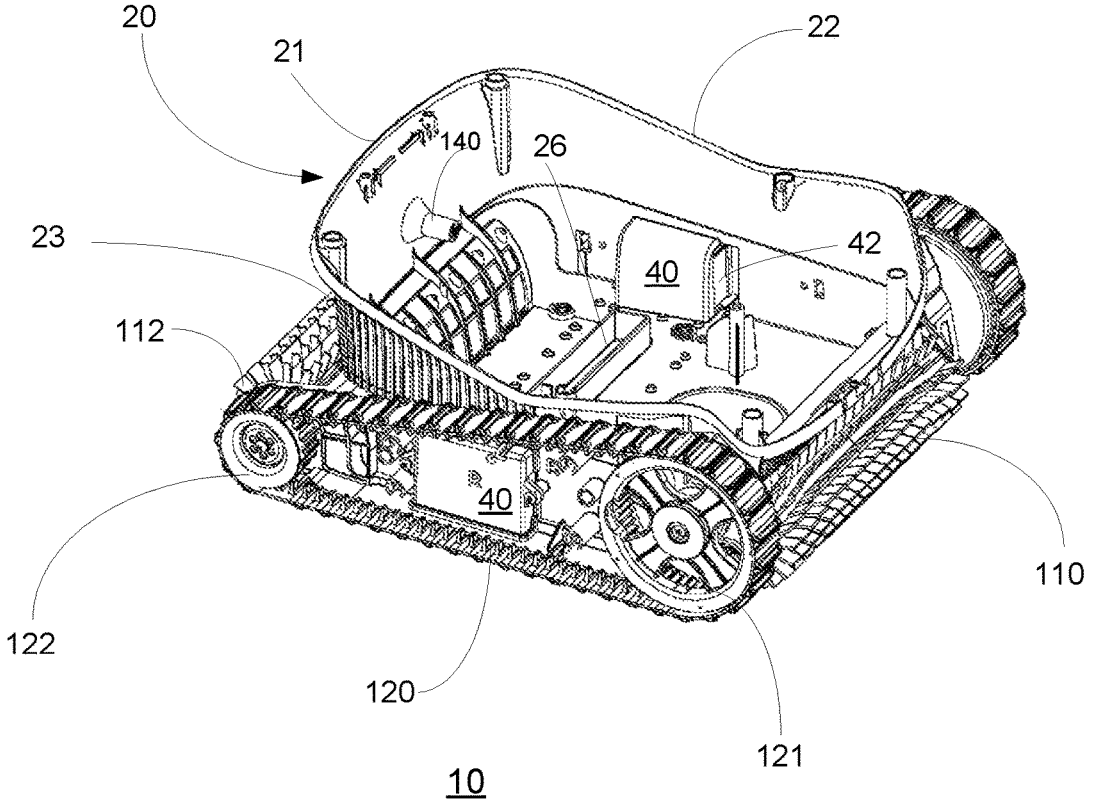
FIG. 1 illustrates a portion of cleaning robot according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

According to an embodiment of the invention there is provided a cleaning robot that may include one or more bypass mechanisms.

Various figures illustrate between one to three bypass mechanisms and it is noted that the number of bypassing mechanisms may be any positive integer (for example—one, two, three, four, five and more).

A bypass mechanism is a mechanical element that allows fluid to bypass a filtering unit. Thus, fluid that flows through a bypass mechanism does not flow through the filtering unit. It is noted that if the filtering unit has multiple filters than the bypass unit may be positioned to bypass one, some or all of the multiple filters of the filtering unit.

A bypass mechanism may include one or more mechanical components but may also include electrical components.

If a cleaning robot includes multiple bypass mechanisms then they all can be the same bypass mechanism, may all be different from each other or may include two or more bypass mechanisms that differ from each other.

Bypass mechanisms may differ from each other by their location, by mode of operation, by size, by shape, by the parameters that control their operation (such as a tilt angle of the cleaning robot or a suction level developed within an internal space of the cleaning robot), by including sensors, by excluding sensors, by including one or more motors, by excluding motors and the like.

Any bypass mechanism may be open or closed. An open bypass mechanism allows the fluid to flow through the bypass mechanism and to exit from the bypass mechanism thereby not flowing through one of more filters. A closed bypass mechanism prevents fluid from flowing through the bypass mechanism and exiting the bypass mechanism. It may prevent the fluid from entering the bypass mechanism, prevent fluid that enters the bypass mechanism to reach an outlet of the bypass mechanism and/or prevent fluid to flow through the outlet of the bypass mechanism.

Any bypass mechanism may have more than two openness levels—and may open at different degrees. Thus, a bypass mechanism may be partially open.

For simplicity of explanation the term "open" refers to a fully open or partially open.

According to an embodiment of the invention a bypass mechanism may provide fluid to a hydraulic movement mechanism even when the filter is clogged.

Because the bypass mechanism may allow un-filtered fluid to propagate within the cleaning robot and to be ejected out of the cleaning robot it may be selectively opened and closed due to an occurrence of events.

For example—the bypass mechanism may be opened when sensing a reduction in the filtered fluid flow intensity and/or pressure level within the cleaning robot or when sensing that the flow intensity and/or pressure level of the filtered fluid is below a threshold.

The sensing may include sensing the flow and/or pressure of fluid before (downstream) and/or after (upstream) the filtering unit, in a path leading to the hydraulic movement mechanism and the like. The flow intensity and/or pressure level can be directly (flow and/or pressure sensing) sensed, indirectly sensed (sensing movements of the hydraulic movement mechanism) or a combination thereof.

Yet for another example—the filtering unit bypass may be opened when sensing that the cleaning robot is about to climb a wall (or is in the progress of climbing a wall). This may be sensed by tracking the tilt angle of the cleaning robot, by using accelerometers and the like.

The opening may occur when sensing a reduction of the flow and/or pressure and climbing of the wall. Different thresholds for flow and/or suction levels may be provided as a function of the activity of the cleaning robot (climbing a wall or horizontal movement).

According to an embodiment of the invention the amount of fluid that may pass through the bypass mechanism may be altered as a function of sensed parameters. For example—the bypass mechanism may be opened to a greater extent when climbing a wall, when the Flow and/or pressure of the filtered fluid is lower, and the like.

The movement of the cleaning robot even when the filtering unit is clogged or almost clogged can assist in the cleanliness of the fluid in the pool by merely moving in the pool, detaching bacteria from the pool walls and floor by contact and assisting in pool filtering devices to filter the fluid by inducing fluid movements within the pool.

According to an embodiment of the invention the bypass mechanism may provide fluid to a hydraulic movement mechanism even when the filtering unit is clogged.

Because the bypass mechanism may allow un-filtered fluid to propagate within the cleaning robot and to be ejected out of the cleaning robot it may be selectively opened and closed due to an occurrence of bypass related events.

For example—the bypass mechanism may be opened when sensing a reduction in the filtered fluid and/or an increase in a suction level within the cleaning robot or both. The sensing may include sensing the flow and/or suction (pressure) of fluid before and/or after the filtering unit, in a path leading to a suction unit, to a hydraulic movement mechanism and the like. The flow and/or suction (pressure) can be directly (flow and/or pressure sensing) sensed, indirectly sensed (sensing movements of the hydraulic movement mechanism) or a combination thereof.

Yet for another example—the bypass mechanism may be opened when sensing that the cleaning robot is about to climb a wall (or is in the progress of climbing a wall).

The opening may occur when sensing a reduction of the Flow and/or pressure and climbing of the wall. Different thresholds for Flow and/or pressure levels may be provided as a function of the activity of the cleaning robot (climbing a wall or horizontal movement).

According to an embodiment of the invention the amount of fluid that may pass through the bypass mechanism may be altered as a function of sensed parameters. For example—the bypass mechanism may be opened to a greater extent when climbing a wall, when the flow and/or pressure of the filtered fluid is below a threshold, and the like.

By providing the bypass mechanism and allowing fluid to flow even when the filtering unit is clogged the cleaning robot may move in the pool. This movement of the cleaning robot even when the filter is clogged or almost clogged can assist in the cleanliness of the fluid in the pool by merely moving the cleaning robot in the pool thereby detaching bacteria from the pool walls and floor by contact and assisting to pool filtering devices to filter the fluid by inducing fluid movements within the pool.

FIG. 1 illustrates a portion of cleaning robot 10 according to an embodiment of the invention.

FIG. 1 illustrates only a part of the cleaning robot as the upper part of the cleaning robot as well as multiple internal components of the cleaning robot (such as a filtering unit, a fluid suction unit, a driving motor and the like) are missing for clarity of explanation.

FIG. 1 illustrates the portion of the cleaning robot as including a housing 20, front brush wheel 110, rear brush wheel 112, and tracks 120 movable by front wheel 121 and/or rear wheel 122. It is noted that the cleaning robot may be moved by other movement elements (for example it may include wheels instead of tracks), may have other cleaning elements and the like.

The cleaning robot of FIG. 1 includes three bypass mechanisms—two bypass mechanisms 40 located at both sides of the housing (near sidewalls 22 and 23 of the housing 20) and one bypass mechanism 140 located at the rear wall 21 of the housing 20. FIG. 1 also shows a filtering unit inlet 26 formed at about the center of the bottom of the housing and positioned between bypass mechanisms 40. FIG. 1 also shows a bypass outlet 42 of bypass mechanism 40.

Each bypass mechanism allows fluid to bypass at least one filter of the filtering unit. The fluid propagates towards a fluid suction unit (such as an impeller) of the cleaning robot that is arranged to direct towards the outlet (of the housing) fluid that passes through the at least one inlet and through at least one of the filtering unit and the bypass mechanism.

Figure 2:
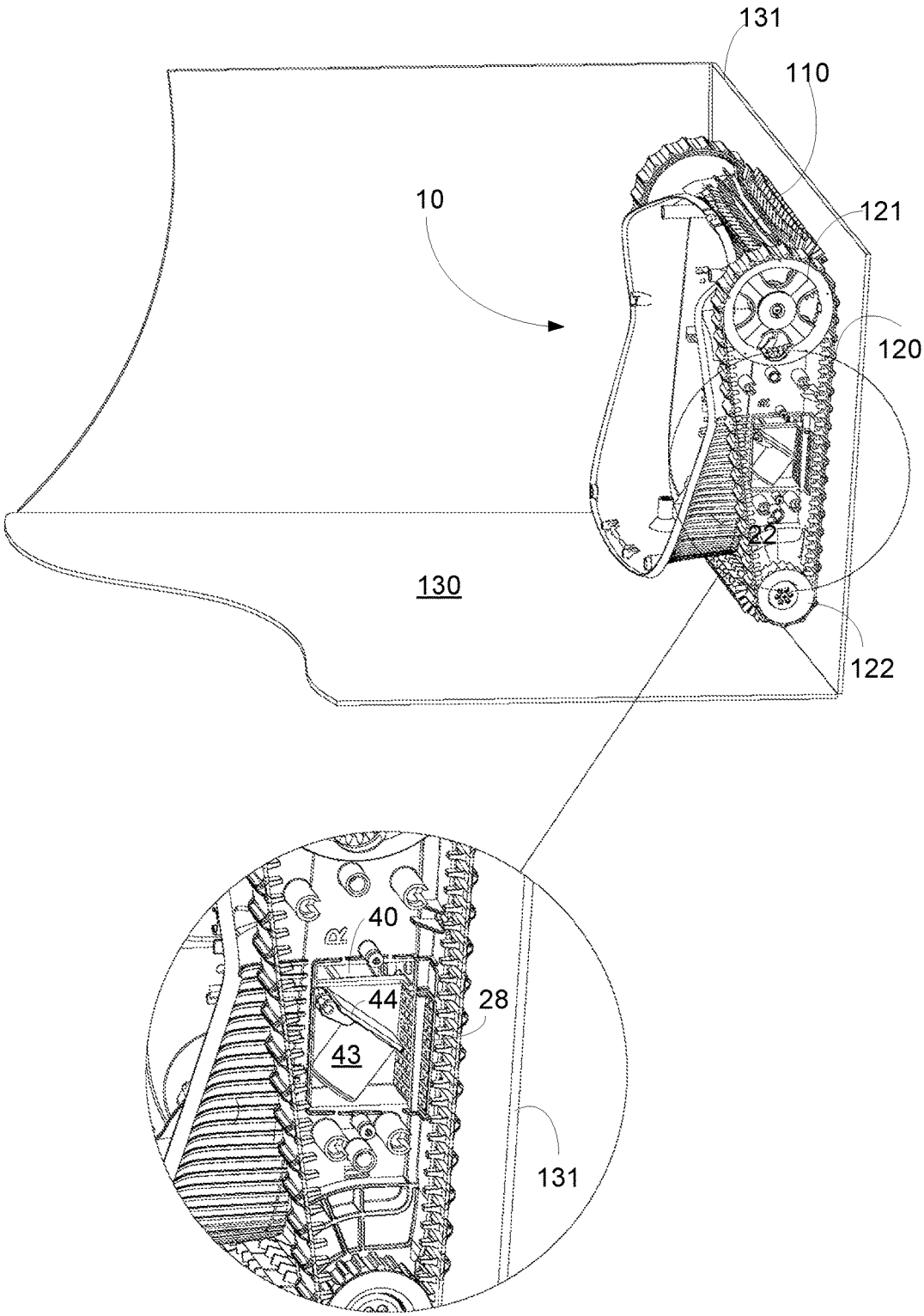
FIG. 2 illustrates a portion of cleaning robot that climbs on a sidewall of a pool according to an embodiment of the invention.
Figure 3:
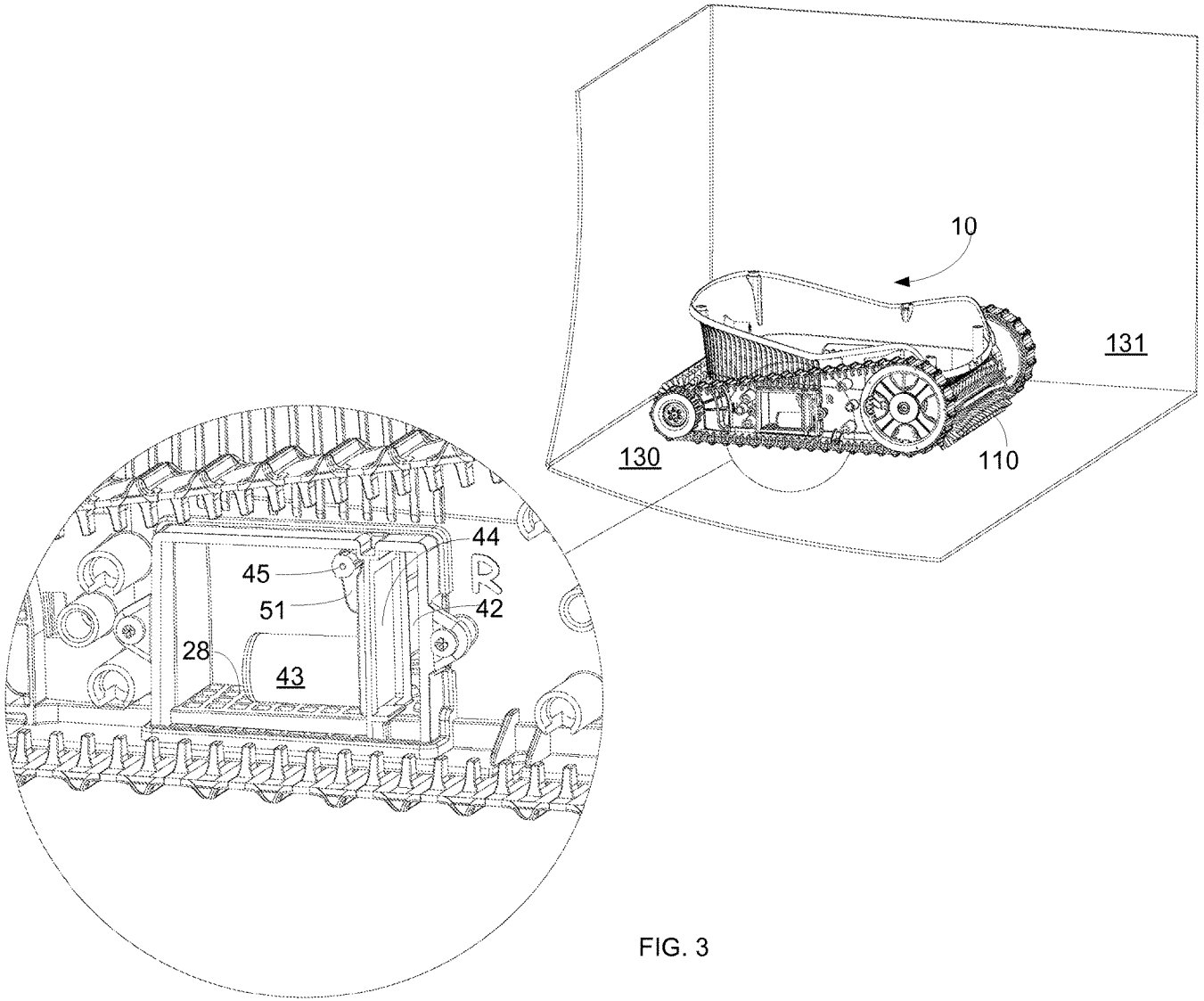
FIG. 3 illustrates a portion of cleaning robot that propagates along a bottom of a pool according to an embodiment of the invention.

FIG. 2 illustrates a portion of cleaning robot 10 that climbs on a sidewall 131 of a pool according to an embodiment of the invention. FIG. 3 illustrates a portion of cleaning robot 10 that propagates along a bottom 130 of a pool according to an embodiment of the invention. Sidewall 131 is vertical and the bypass mechanism 40 is opened at its maximal extent. FIG. 2 illustrates an open bypass mechanism 40 while FIG. 3 illustrates a closed bypass mechanism.

In FIGS. 2 and 3 the bypass mechanism 40 is illustrated as including door 44. Door 44 is movable between (a) a closed position (FIG. 3) in which the door prevents fluid to exit the bypass mechanism and flow towards the fluid suction unit, and (b) an open position (FIG. 2) in which the door allows fluid to exit from the bypass mechanism and flow towards the fluid suction unit.

Door 44 is pivotally coupled to a first rotation axis 45 and rotates between the closed position and the open position.

FIGS. 2 and 3 also shows that the door 44 is coupled to a weight 43. The weight 43 assists in opening the door 44 when the cleaning robot starts to tilt and closing the door 44 when the cleaning robot is horizontal. Alternatively, the door 44 may be heavy enough and does not require an additional weight 43.

Figure 15:
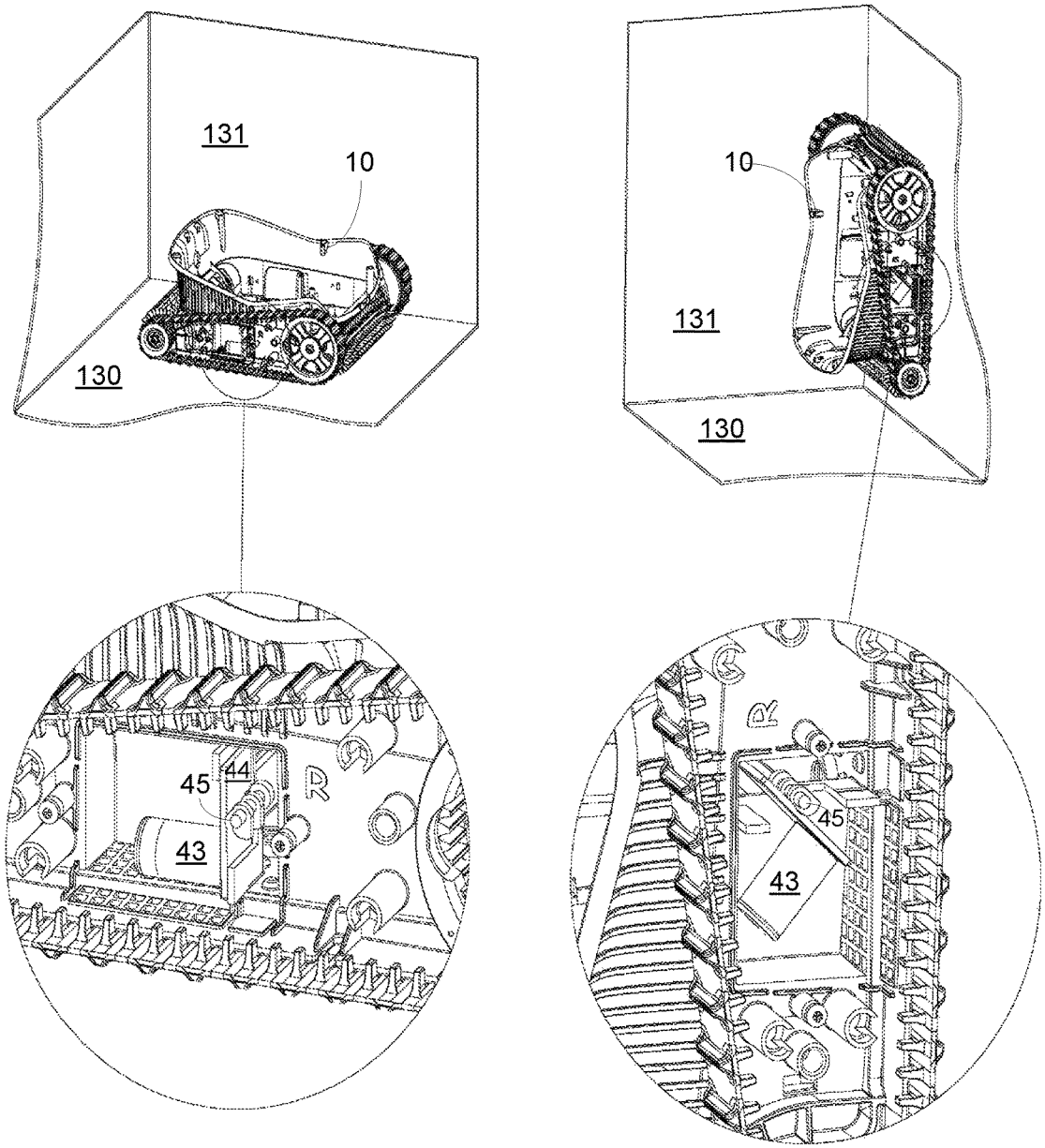
FIG. 15 illustrates a portion of cleaning robot that climbs on a sidewall of a pool and a portion of cleaning robot that propagates along a bottom of a pool according to an embodiment of the invention.

FIGS. 2 and 3 illustrate the weight 43 is being connected to a door 44 near a lower end of the door and illustrate the first rotation axis 45 is located near an upper end of the door 44. The first rotation axis 45 may alternatively be located near the center of the door (as illustrated in FIG. 15) in order to reduce the needed weight or mass of 43. It is noted that the relative locations of the first rotation axis 45 and the weight 43 may differ from those illustrated in FIGS. 2 and 3.

FIGS. 2 and 3 also show that the door 44 is not directly connected to the rotation axis but show a hinge 51 that is pivotally snapped-in or coupled to the first rotation axis 45 and interfaces with the door 44. FIGS. 2 and 3 also illustrate a bypass path inlet 28 that is covered by a filtering mesh.

Figure 4:
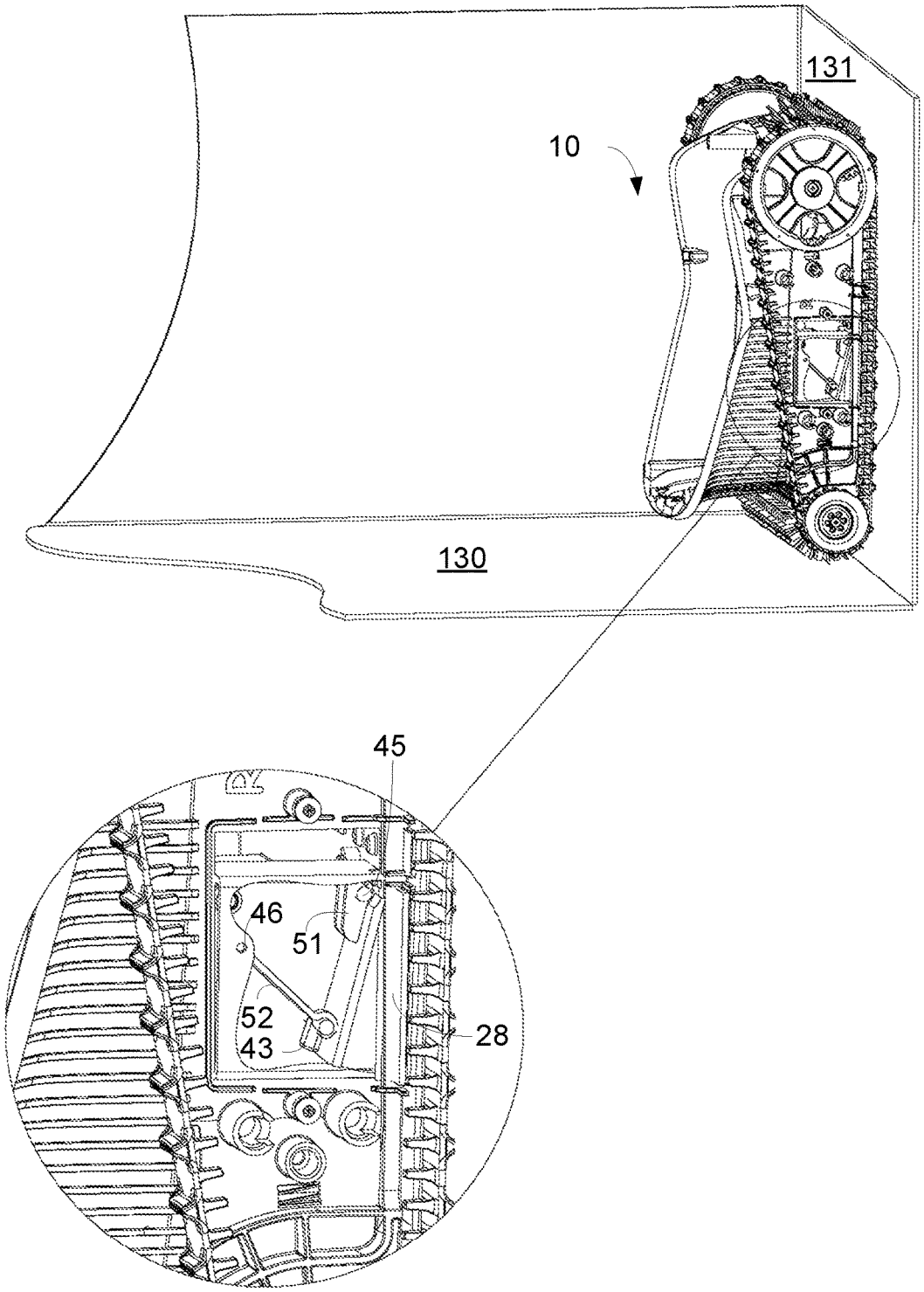
FIG. 4 illustrates a portion of cleaning robot that climbs on a sidewall of a pool according to an embodiment of the invention.
Figure 5:
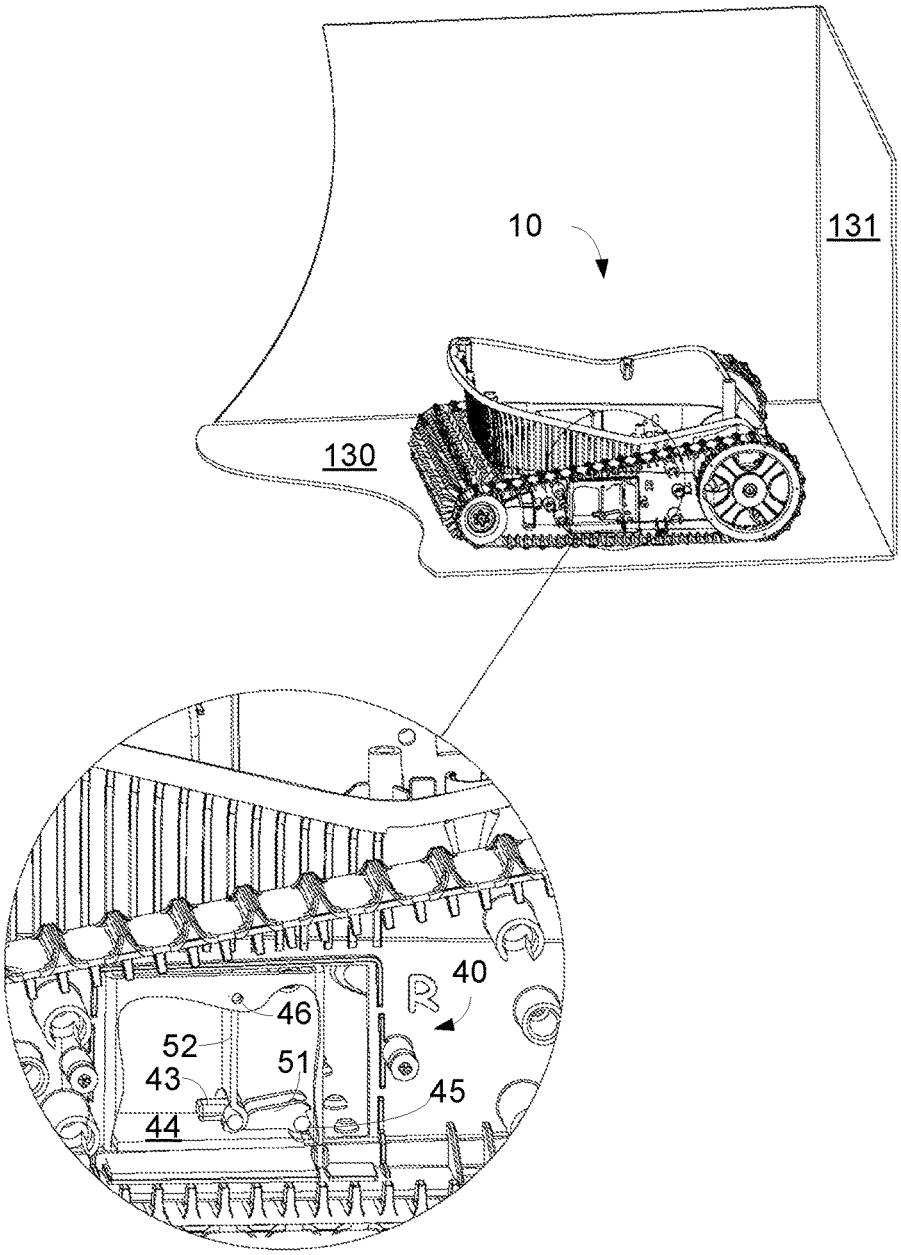
FIG. 5 illustrates a portion of cleaning robot that propagates along a bottom of a pool according to an embodiment of the invention.

FIG. 4 illustrates a portion of cleaning robot 10 that climbs on a sidewall 131 of a pool according to an embodiment of the invention. FIG. 5 illustrates a portion of cleaning robot 10 that propagates along a bottom 130 of a pool according to an embodiment of the invention. Sidewall 131 is vertical and the bypass mechanism 40 is opened at its maximal extent. FIG. 4 illustrates an open bypass mechanism 40 while FIG. 5 illustrates a closed bypass mechanism.

FIGS. 4 and 5 illustrate a door 44 that is connected to a hinge 51 that is pivotally snapped-in or coupled to a first rotation axis 45 thereby allowing the door 44 to pivot about the first rotation axis 45.

The door 44 of FIGS. 4 and 5 is coupled to a lever 52 that is pivotally coupled to a second rotation axis 46. The second level 52 may be arranged to limit a pivoting of the door 44 about the first rotation axis 45. The lever 52 may be oriented at about ninety degrees to the tilt angle of the cleaning robot but this is not necessarily so.

FIGS. 4 and 5 illustrate the lever 52, connected or snapped-in to a weight 43 (or unify it by 43), and interfaces with door 44.

FIGS. 4 and 5 illustrate that the weight 43 is arranged to slide across the door 44 when the door moves between the close position and the open position.

FIGS. 2-6 illustrates bypass mechanisms 40 that their openness level depended upon the tilt angle of the cleaning robot. The tilt angle may be defined as the angle between the cleaning robot and the horizon.

It is noted that although FIGS. 2-6 do not show sensors for triggering the opening (and/or closing) of the bypass mechanisms—that the cleaning robot may include sensors that may sense the tilt angle of the cleaning robot and that the sensed tilt robot may be used to trigger (for example by using a motor) the opening and/or closing of a bypass mechanism.

Accordingly, there may be provided a cleaning robot wherein the bypass mechanism is arranged to allow fluid to pass through the bypass mechanism when the cleaning robot is tilted by at least a predefined tilt angle. This tilt angle may be measured by a sensor (such as sensor 210 of FIGS. 10, 12 and 13).

Figure 9:
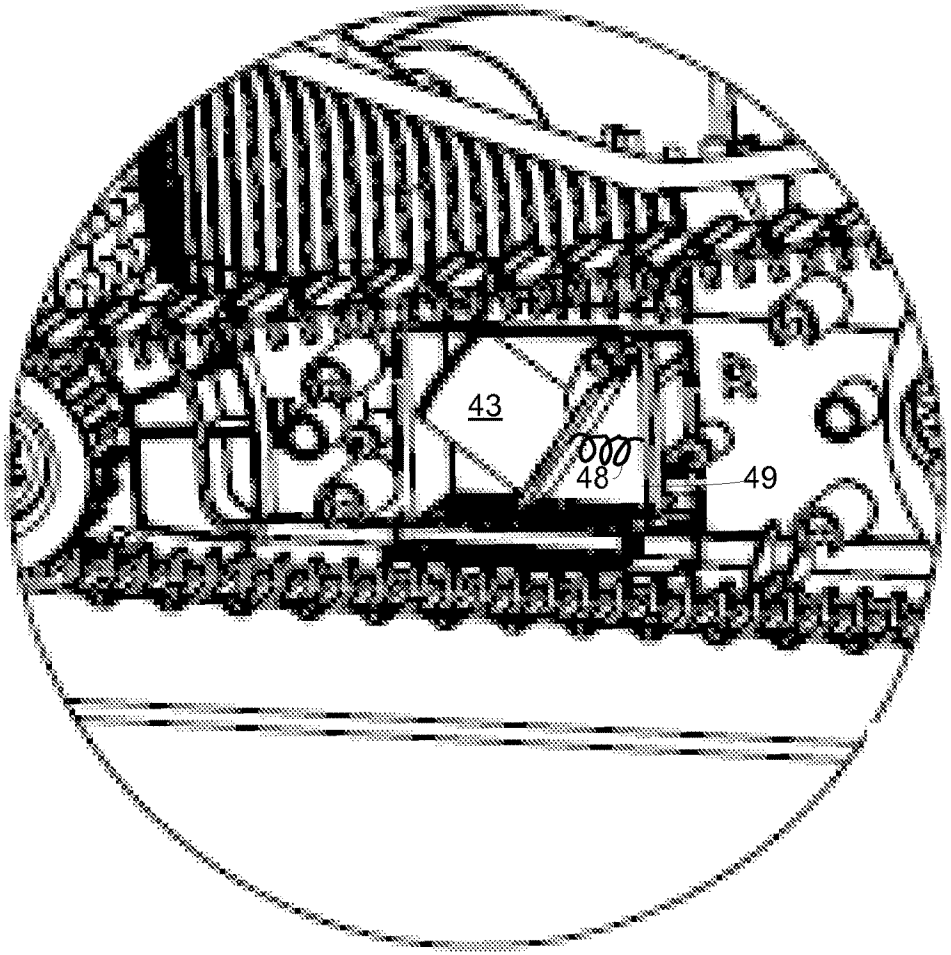
FIG. 9 illustrates a portion of a cleaning robot according to an embodiment of the invention.

Yet for another embodiment of the invention the mechanical elements of the bypass mechanism may be arranged to allow opening the bypass mechanism only when the tilt angle exceeds a predetermined tilt angle. Referring to the example set forth in FIG. 9, a spring 48 or other limiting element may be connected to door 44, or to weight 43 and to a frame 49 of the bypass mechanism in order to counter the movement of the weight 43 or door 44 so that only at a predefined tilt angle the door 44 will move and at least partially open the bypass mechanism 40. The predefined tilt angle may range between 70 and 110 degrees, may range between 50 and 90 degrees, between 20 and 80 degrees and the like.

Figure 6:
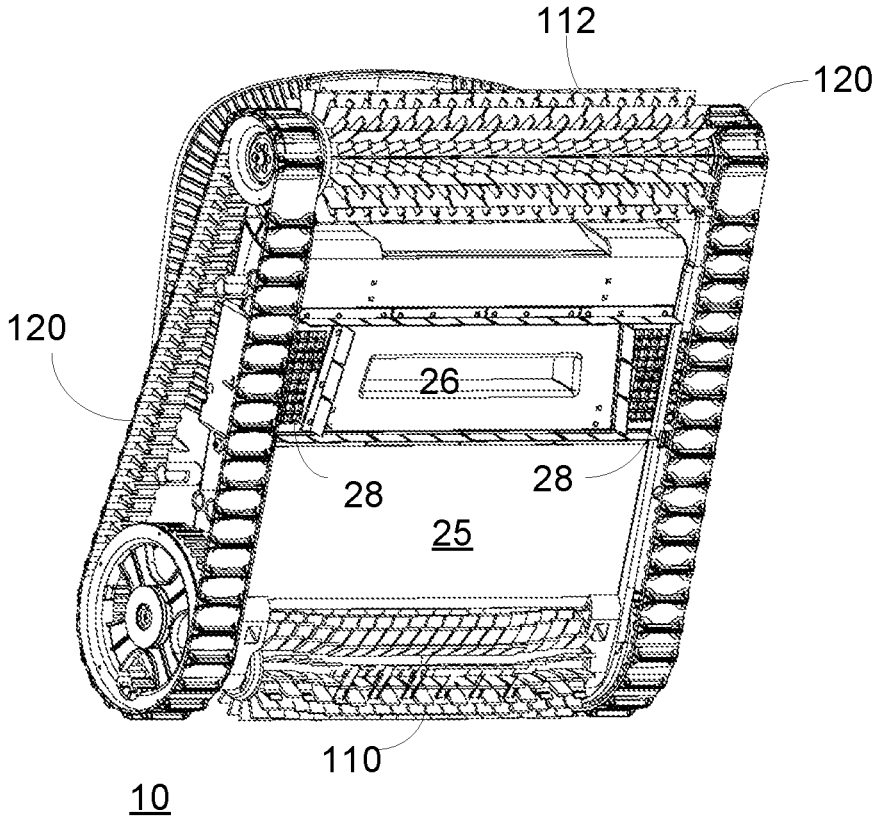
FIG. 6 is a bottom view of a cleaning robot according to an embodiment of the invention.

FIG. 6 is a bottom view of a cleaning robot 10 according to an embodiment of the invention.

It shows a filtering unit inlet 26 located at about the center of the bottom 25 of the cleaning robot as well as two bypass path inlets 28 that are covered by a filtering mesh positioned at both sides of the filtering unit inlet 26. This figure also shows front brush wheel 110, rear brush wheel 112, front wheel 121 and read wheel 122.

Figure 7:
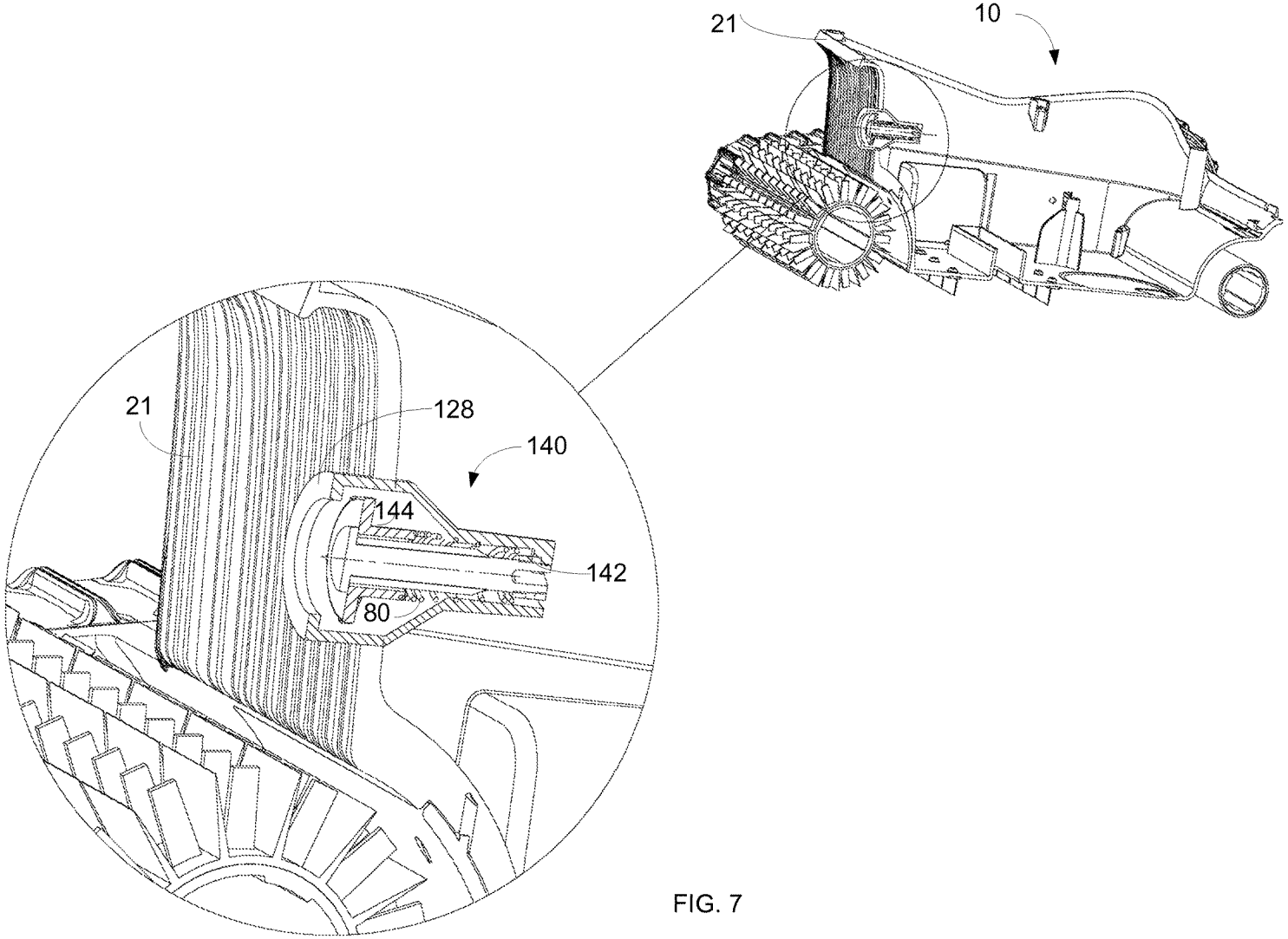
FIG. 7 is a cross sectional view of a portion of cleaning robot taken along a longitudinal axis of the cleaning robot according to an embodiment of the invention.

FIG. 7 is a cross sectional view of a portion of cleaning robot 10 taken along a longitudinal axis of the cleaning robot according to an embodiment of the invention.

Figure 8:
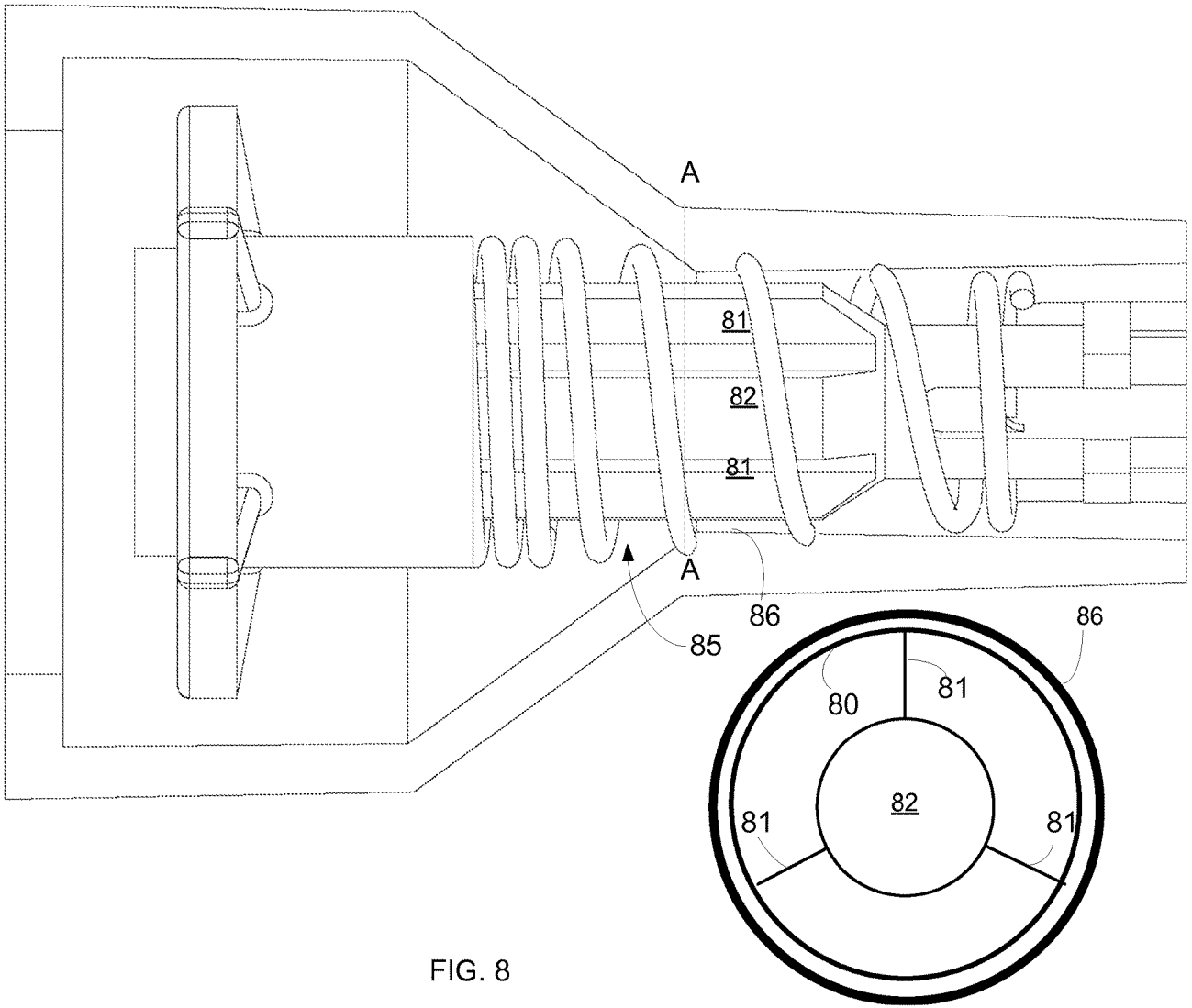
FIG. 8 is a cross sectional view of a bypass mechanism taken along a longitudinal axis of the bypass mechanism according to an embodiment of the invention.

FIG. 8 is a cross sectional view of a bypass mechanism 140 taken along a longitudinal axis of the bypass mechanism 140 according to an embodiment of the invention. FIG. 8 also provides a cross sectional view of the bypass mechanism 140 taken along axis A-A that is normal to the longitudinal axis of the bypass mechanism 140.

Bypass mechanism 140 is installed in wall 21 of housing 20. Bypass mechanism 140 may also be installed on other walls such as for example, sidewall 22 of the pool cleaner. Multiple bypass mechanisms may be used. It is pressure (suction) activated—it has a sealing element 144 that is forced by a spring 80 to move toward an exterior of the cleaning robot 10 thereby closing the inlet 128 of bypass mechanism 140. On the other hand a pressure difference between the interior and the exterior of the cleaning robot 10 and/or suction applied by a fluid suction unit within an internal space of the cleaning robot (not shown) forces the sealing element 144 to move towards the interior of the cleaning robot 10 thereby opening the inlet 128 of bypass mechanism 140 and allowing fluid to pass through bypass mechanism and through outlet 142. Accordingly—there is a suction (or pressure) thresholds that overcomes the spring and opens the bypass mechanism.

The sealing element 144 moves along an axis that is normal to the wall 21. It includes a fluid conduit that has different cross sections at different location thus allowing a movement of the sealing element along the axis opens and closes the bypass mechanism 140.

Accordingly—the sealing element 144 may move between (a) a closed position in which the sealing element 144 prevents fluid to exit the bypass mechanism and flow towards the fluid suction unit, and (b) an open position in which the sealing element 144 allows fluid to exit from the bypass mechanism and flow towards the fluid suction unit.

FIG. 8 illustrates that spring 80 is supported by and moves along a supporting element 86 that has a core 82 and three spaced apart wings 81 extending from the core 82. Accordingly—the spaced apart wings 81 which contact the spring 80 define openings through which fluid may flow when the bypass mechanism 140 is open. The inner wall 86 of the bypass mechanism 140 may be larger than the exterior of spring 80.

Figure 10:
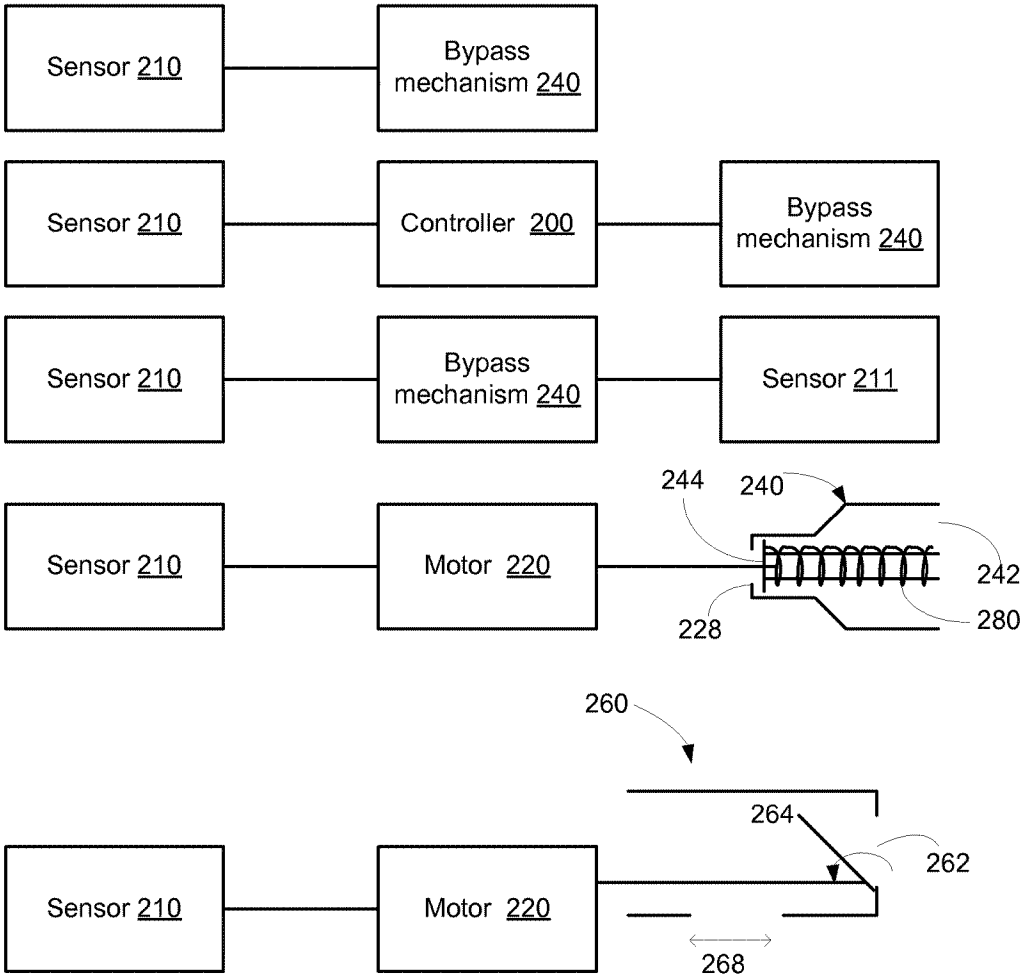
FIG. 10 illustrates various combinations of sensors and bypass mechanisms according to an embodiment of the invention.

FIG. 10 illustrates various combinations of sensors and bypass mechanisms according to an embodiment of the invention. FIG. 10 shows (from top to bottom) the following combinations:

a. A sensor 210 coupled to a bypass mechanism 240. The sensor may sense pressure levels, tilt angles and may be used to control the bypass mechanism.

b. A controller 200 that is coupled to sensor 210 and to the bypass mechanism 240. The sensor 210 may sense pressure levels, tilt angles and may send sensing signals to controller 200 that may control, in response to the sensing signals, the bypass mechanism.

c. Multiple (such as two) sensors 210 and 211 that are coupled to bypass mechanism 240 and their readings may be used for controlling the bypass mechanism 240. Alternatively—the sensors may be coupled to controller 200 that in turn controls the bypass mechanism 240.

d. Sensor 210 that controls motor 220 that in turn may manipulate (for example push and/or pull) sealing element 244 of bypass mechanism 240. The bypass mechanism 240 may resemble (or may differ) the bypass mechanism 140 of FIG. 8. The sealing element 244 can be forced by spring 280 to close the bypass mechanism 240. The bypass mechanism 240 has an inlet 228 and an outlet 242 that is smaller than the inlet 228.

e. Sensor 210 that controls motor 220 that in turn may manipulate (for example rotate) door 264 of bypass mechanism 260. The bypass mechanism 260 may resemble (or may differ) the bypass mechanism 40 of FIGS. 2-4. The door 264 can rotate about a rotation axis thereby close or open the bypass mechanism 260. The bypass mechanism 260 has an inlet 268 and a filtering mesh and an outlet 262.

Figure 11:
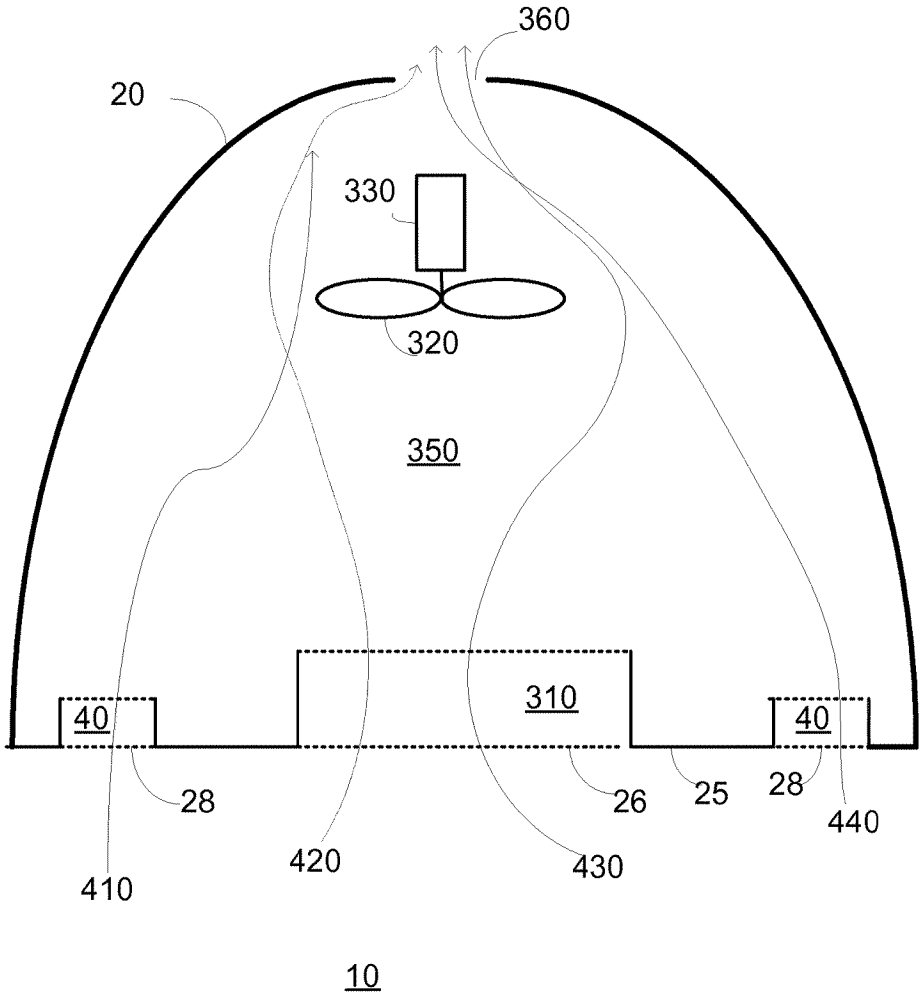
FIG. 11 is a cross sectional view of a cleaning robot according to an embodiment of the invention.
Figure 12:
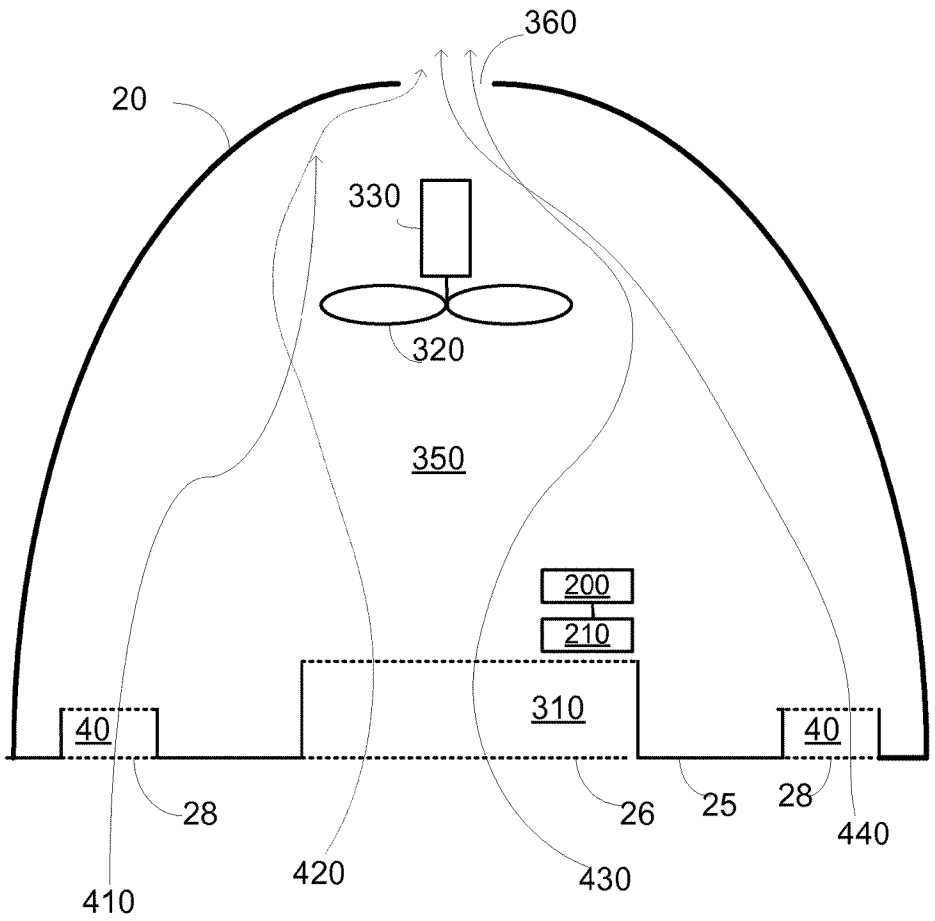
FIG. 12 is a cross sectional view of a cleaning robot according to an embodiment of the invention.
Figure 13:
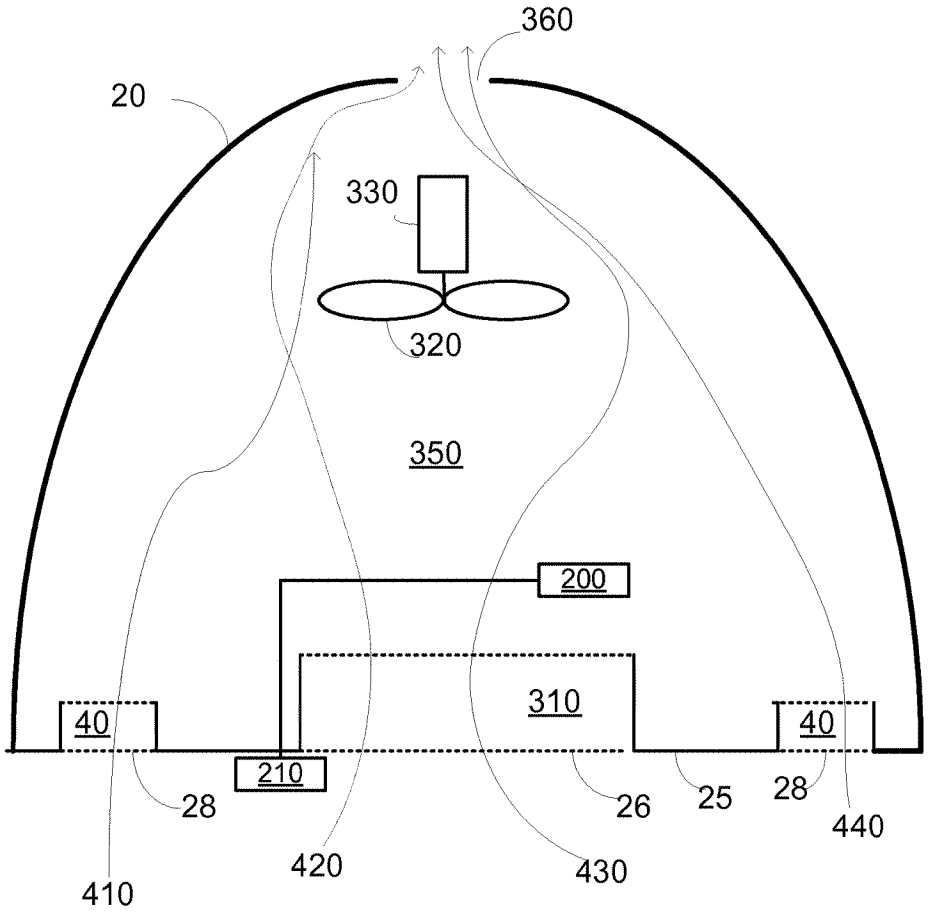
FIG. 13 is a cross sectional view of a cleaning robot according to an embodiment of the invention.
Figure 14:
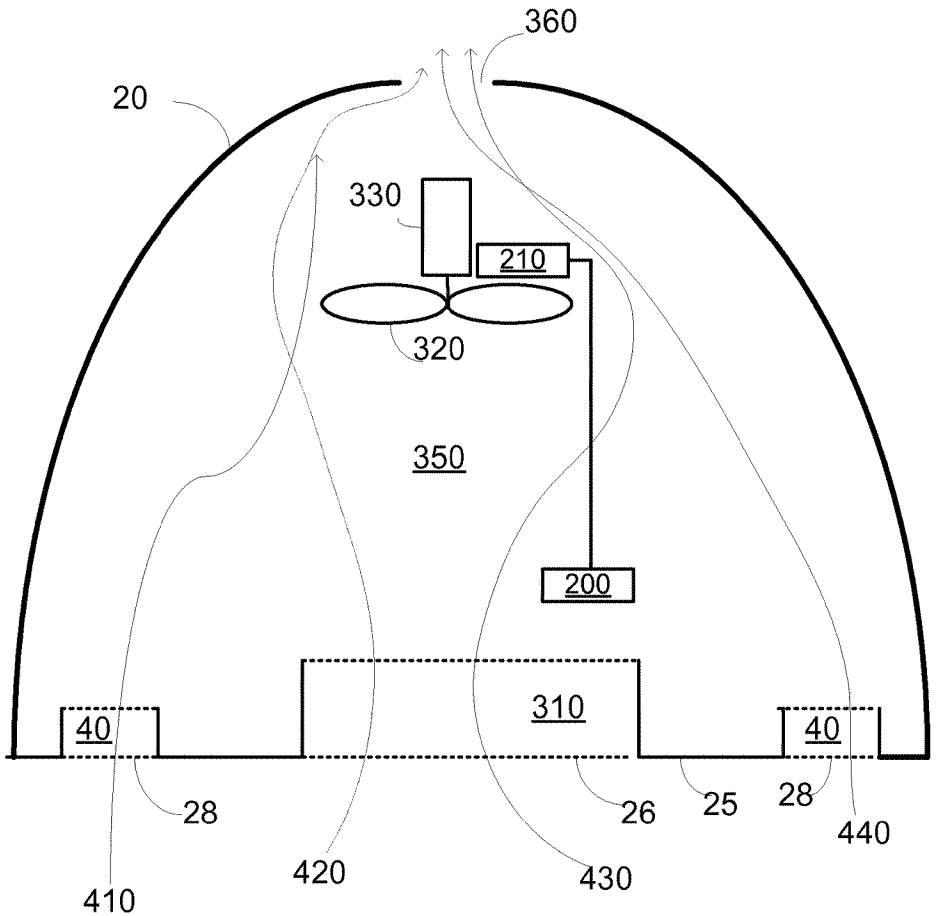
FIG. 14 is a cross sectional view of a cleaning robot according to an embodiment of the invention.

FIG. 11 is a cross sectional view of a cleaning robot 10 according to an embodiment of the invention. FIG. 12 is a cross sectional view of a cleaning robot 10 according to an embodiment of the invention. FIG. 13 is a cross sectional view of a cleaning robot 10 according to an embodiment of the invention. FIG. 14 is a cross sectional view of a cleaning robot 10 according to an embodiment of the invention.

The cross section is taken along a transverse axis of the cleaning robot 10.

FIGS. 11, 12, 13 and 14 differ by each other by:

a. The lack of a sensor and a controller 200 (FIG. 11).

b. The inclusion of a controller 200 and the sensor 210 at a point that is upstream (after) the filtering unit 310. (FIG. 12)

c. The inclusion of the controller 200 upstream of the filtering unit 310 while the sensor 210 is located downstream the filtering unit 310. (FIG. 13)

d. The inclusion of a controller 200 within internal space 350 wherein the sensor 210 monitors the rotational speed of the suction unit (for example—of its impeller 320). (FIG. 14)

FIGS. 11, 12, 13 and 14 show the flow of fluid through bypass mechanism 40—when the bypass mechanism 40 is open (see arrows 410 and 440) or through filtering unit 310 (arrows 420 and 430). FIG. 12 also illustrates a bypass path inlet 28 that is covered by a filtering mesh.

In FIG. 12 the sensor 210 may sense the flow of fluid at a point that is upstream to the filtering unit 310. In FIG. 13 the sensor 210 may sense the flow of fluid at a point that is downstream to the filtering unit 310.

The fluid that passes bypass mechanism 40 or filtering unit 310 enter an internal space 350 of the housing 20 and is drawn into a filtering unit 310 (illustrated as including impeller 320 and pump motor 330 for driving the impeller 320) towards the outlet 360 of housing 20.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A cleaning robot comprising: a housing comprising at least one inlet and an outlet; a filtering unit, located within the housing, for filtering fluid; a bypass mechanism for bypassing the filtering unit; and a fluid suction unit that is arranged to direct towards the outlet fluid that (a) passes through the at least one inlet and (b) passes through at least one of the filtering unit and the bypass mechanism.

2. The cleaning robot according to claim 1 wherein the bypass mechanism is arranged to allow fluid to pass through the bypass mechanism when the cleaning robot is tilted by at least a predefined tilt angle.

3. The cleaning robot according to claim 2 wherein predefined tilt angle ranges between 70 and 110 degrees.

4. The cleaning robot according to claim 2 wherein predefined tilt angle is 90 degrees.

5. The cleaning robot according to claim 1 wherein a degree of openness of the bypass mechanism is responsive to a tilt angle of the cleaning robot.

6. The cleaning robot according to claim 1 wherein the bypass mechanism comprises a door; wherein the door is movable between (a) a closed position in which the door prevents fluid to exit the bypass mechanism and flow towards the fluid suction unit, and (b) an open position in which the door allows fluid to exit from the bypass mechanism and flow towards the fluid suction unit.

7. The cleaning robot according to claim 6 wherein the door is pivotally coupled to a rotation axis and wherein the door rotates between the closed position and the open position.

8. The cleaning robot according to claim 7 wherein the door is coupled to a weight.

9. The cleaning robot according to claim 8 wherein the weight is connected to a door at a location that is near a lower end of the door and wherein the rotation axis is located near an upper end of the door.

10. The cleaning robot according to claim 7 wherein the door is connected to a lever that is pivotally coupled to a rotation axis.

11. The cleaning robot according to claim 7 wherein the door is connected to a hinge that is pivotally coupled to a first rotation axis thereby allowing the door to pivot about the first rotation axis.

12. The cleaning robot according to claim 11 wherein the door is coupled to a lever that is pivotally coupled to a second rotation axis; wherein the lever is arranged to limit a pivoting of the door about the first rotation axis.

13. The cleaning robot according to claim 12 wherein the lever is connected to a weight.

14. The cleaning robot according to claim 12 wherein the weight is arranged to slide across the door when the door moves between the close position and the open position.

15. The cleaning robot according to claim 1 wherein the bypass mechanism is arranged to be opened in response to a suction level developed within an internal space formed in the housing.

16. The cleaning robot according to claim 15 wherein the bypass mechanism comprises a bypass mechanism inlet, a bypass mechanism outlet and a sealing element; wherein the sealing element is arranged to be moved between (a) a closed position in which the sealing element prevents fluid to exit the bypass mechanism and flow towards the fluid suction unit, and (b) an open position in which the sealing element allows fluid to exit from the bypass mechanism and flow towards the fluid suction unit.

17. The cleaning robot according to claim 15 wherein the bypass mechanism comprises a spring that induces the sealing element to move towards the close position.

18. The cleaning robot according to claim 17 wherein when the suction level developed within an internal space of the housing exceeds a suction threshold the sealing element is moved towards the open position.

19. The cleaning robot according to claim 1 wherein the bypass mechanism is arranged to be opened in response to an intensity of flow of fluid at a point that is upstream to the filtering unit.

20. The cleaning robot according to claim 1 wherein the bypass mechanism is arranged to be opened in response to an intensity of flow of fluid at a point that is downstream to the filtering unit.

21. The cleaning robot according to claim 1 wherein the bypass mechanism is arranged to be opened in response to a rotational speed of a hydraulic movement mechanism of the cleaning robot.

22. The cleaning robot according to claim 1 further comprising a sensor;

wherein the sensor is arranged to detect an occurrence of a bypass related event and wherein the bypass mechanism is arranged to respond to the occurrence of the bypass related event.

23. The cleaning robot according to claim 22 wherein the bypass mechanism comprises a motor that is arranged to affect an openness level of the bypass mechanism in response to the occurrence of the bypass related event.

24. The cleaning robot according to claim 22 wherein the sensor is a robot tilt angle sensor.

25. The cleaning robot according to claim 22 wherein the sensor is a suction sensor.

26. The cleaning robot according to claim 1 wherein the at least one inlet comprises a bypass mechanism inlet and a filtering unit inlet.

27. The cleaning robot according to claim 1 wherein the at least one inlet comprises multiple bypass mechanism inlets and a filtering unit inlet.

28. The cleaning robot according to claim 1 wherein the bypass mechanism is closer to a sidewall of the housing than the filtering unit.

29. The cleaning robot according to claim 1 wherein the bypass mechanism is connected to a sidewall of the housing.

30. The cleaning robot according to claim 1 wherein the bypass mechanism extends outside a sidewall of the housing.

31. The cleaning robot according to claim 1 comprising at least one additional bypass mechanism; wherein the bypass mechanism and the at least one additional bypass mechanism form a plurality of bypass mechanisms.

32. The cleaning robot according to claim 31 wherein at least two bypass mechanisms of the plurality of bypass mechanisms differ from each other.

33. The cleaning robot according to claim 31 wherein at least two bypass mechanism of the plurality of bypass mechanisms differ from each other by a triggering event that triggers an opening of the bypass mechanism.

34. The cleaning robot according to claim 31 wherein at least two bypass mechanisms of the plurality of bypass mechanisms operate independently from each other.

35. The cleaning robot according to claim 31 wherein a first bypass mechanism of the plurality of bypass mechanisms is responsive to an openness level of another bypass mechanism of the plurality of bypass mechanisms.

36. The cleaning robot according to claim 31 wherein an opening of first bypass mechanism of the plurality of bypass mechanisms eases an opening of another bypass mechanism of the plurality of bypass mechanisms.

37. The cleaning robot according to claim 31 wherein an opening of first bypass mechanism of the plurality of bypass mechanisms increases a difficulty of an opening of another bypass mechanism of the plurality of bypass mechanisms.

38. The cleaning robot according to claim 31 wherein a first bypass mechanism of the plurality of bypass mechanisms is arranged to be opened in response to a tilt level of the cleaning robot and a second bypass mechanism of the plurality of bypass mechanisms is arranged to be opened in response to a clogging level of the filtering unit.

39. The cleaning robot according to claim 31 wherein a first bypass mechanism of the plurality of bypass mechanisms is arranged to be opened in response to a tilt level of the cleaning robot and a second bypass mechanism of the plurality of bypass mechanisms is arranged to be opened in response to a suction level developed within an internal space formed in the housing.

40. The cleaning robot according to claim 31 wherein a first bypass mechanism of the plurality of bypass mechanisms has an opening located at a bottom of the housing and wherein a second bypass mechanism of the plurality of bypass mechanisms has an opening located at a sidewall of the housing.

41. The cleaning robot according to claim 31 wherein a first bypass mechanism of the plurality of bypass mechanisms comprises a sensor and a motor activated by the sensor and wherein a second bypass mechanism of the plurality of bypass mechanisms does not include a sensor or a motor activated by the sensor.

42. The cleaning robot according to claim 1 wherein a degree of openness of the bypass mechanism is responsive to (a) a tilt angle of the cleaning robot and to (b) a suction level developed within an internal space formed in the housing.

* * * * *